US009966688B2

(12) United States Patent
Monzaviyan

(10) Patent No.: US 9,966,688 B2
(45) Date of Patent: May 8, 2018

(54) SAFETY FACEPLATE FOR ELECTRICAL RECEPTACLE

(71) Applicant: CANMIND INNOVATIONS INC., Toronto (CA)

(72) Inventor: Sameem Monzaviyan, Toronto (CA)

(73) Assignee: CANMIND INNOVATIONS INC., Toronto, Ontario (CA)

( * ) Notice: Subject to any disclaimer, the term of this patent is extended or adjusted under 35 U.S.C. 154(b) by 0 days. days.

(21) Appl. No.: 15/481,026

(22) Filed: Apr. 6, 2017

(65) Prior Publication Data

US 2017/0294732 A1 Oct. 12, 2017

Related U.S. Application Data

(60) Provisional application No. 62/319,095, filed on Apr. 6, 2016.

(51) Int. Cl.

| | |
|---|---|
| ***H01R 13/447*** | (2006.01) |
| ***H01R 13/443*** | (2006.01) |
| ***H01R 13/453*** | (2006.01) |
| ***H01R 25/00*** | (2006.01) |

(52) U.S. Cl.

CPC ..... *H01R 13/447* (2013.01); *H01R 25/006* (2013.01)

(58) Field of Classification Search

CPC ..... H01R 13/447; H01R 13/4532; H01R 13/443; H01R 13/453; H01R 13/4538; H01R 13/6397; H01R 13/652; H01R 24/78; H01R 25/006; H02G 3/14

USPC ..... 174/67, 66, 53; 439/136, 145, 373, 135, 439/139, 140, 143, 911

See application file for complete search history.

(56) References Cited

U.S. PATENT DOCUMENTS

| | | | | |
|---|---|---|---|---|
| 2,820,842 | A | 1/1958 | Meistrell | |
| 3,068,442 | A | 12/1962 | Kubik et al. | |
| 4,584,430 | A | 4/1986 | Belknap | |
| 4,605,270 | A | 8/1986 | Aslizadeh | |
| 4,640,564 | A | 2/1987 | Hill | |
| 4,774,384 | A | 9/1988 | Gregory | |
| 5,240,426 | A | 8/1993 | Barla | |
| 5,449,860 | A * | 9/1995 | Buckshaw | H02G 3/14 174/67 |
| 5,563,373 | A | 10/1996 | Doroslovac | |
| 5,813,873 | A * | 9/1998 | McBain | H01R 13/443 439/145 |
| 6,051,788 | A | 4/2000 | Nichols | |
| 6,159,034 | A | 12/2000 | Royer | |
| 6,364,673 | B1 | 4/2002 | Lee | |

(Continued)

*Primary Examiner* — James Harvey
*Assistant Examiner* — Matthew T Dzierzynski
(74) *Attorney, Agent, or Firm* — Bhole IP Law; Avil Bhole; Marc Campert

(57) ABSTRACT

There is provided a faceplate for an electrical receptacle having a safety measure, and a method thereof. The faceplate including: a cover mountable on an electrical receptacle, the cover having cover apertures corresponding to electrical terminals of electrical sockets; a pair of horizontally opposed pinching members on the cover; and a shield connected to the pair of horizontally opposed pinching members and mutually biased to block access to at least one of the electrical sockets, the shield configured to permit access to the at least one of the electrical sockets while the pair of horizontally opposed pinching members are engaged by a user.

15 Claims, 12 Drawing Sheets

(56) References Cited

U.S. PATENT DOCUMENTS

| | | | | |
|---|---|---|---|---|
| 6,986,674 | B1 | 1/2006 | Gorman | |
| 7,005,580 | B1 | 2/2006 | Craig | |
| 7,094,969 | B1 | 8/2006 | In | |
| 7,098,403 | B2 * | 8/2006 | Jolley | H02G 3/14 174/66 |
| 7,334,731 | B1 * | 2/2008 | McLean | G06K 19/07 235/441 |
| 7,438,567 | B2 * | 10/2008 | Nalwad | H01R 13/4532 439/137 |
| 7,541,541 | B1 * | 6/2009 | Baldwin | H02G 3/14 174/66 |
| 7,595,449 | B1 | 9/2009 | Dyderski | |
| 7,633,009 | B1 * | 12/2009 | Baldwin | H02G 3/14 174/66 |
| 8,044,299 | B2 * | 10/2011 | Weeks | H01R 13/4534 174/53 |
| 8,187,011 | B1 * | 5/2012 | Baldwin | H01R 13/4534 439/137 |
| 8,242,362 | B2 * | 8/2012 | Castaldo | H01R 13/4534 174/53 |
| 8,344,251 | B2 * | 1/2013 | Eshelman | H02G 3/14 174/66 |
| 8,399,765 | B1 * | 3/2013 | Baldwin | H02G 3/14 174/66 |
| 8,563,859 | B1 | 10/2013 | Baldwin et al. | |
| 8,568,152 | B1 * | 10/2013 | Weeks | H05K 5/02 439/137 |
| 8,888,514 | B2 * | 11/2014 | Baldwin | H01R 13/4534 439/137 |
| 2003/0019652 | A1 * | 1/2003 | Shoemaker | H01R 13/4534 174/67 |
| 2009/0236115 | A1 * | 9/2009 | Li | H01R 13/4534 174/53 |

* cited by examiner

SAFETY FACEPLATE FOR ELECTRICAL RECEPTACLE

TECHNICAL FIELD

The present disclosure relates generally to faceplates for electrical receptacles and more specifically to a faceplate having a safety measure.

BACKGROUND

Electrical receptacles have slots that expose people, particularly children, to potentially lethal electrical shock hazards. Children being curious by nature are inclined to test and probe their environments and may stick their fingers or other small objects into the prong receiving openings of electrical receptacles. A person can be shocked if they are in simultaneous contact with a live conductor and a low impedance path to ground. To avoid this risk, there are conventional systems currently used to discourage objects being inserted into electrical receptacles and people being shocked.

Conventional approaches to discourage tampering with electrical receptacles can include, for example, manual insertion of nonconductive receptacle caps to cover the receptacle prongs. These caps, however, significantly reduce electrical receptacle convenience. In order to insert a plug the caps have to be completely removed. Inserting a plug may result in the caps being lost or misplaced and the caps being fairly small in size can serve as a choking hazard for children. Electrical receptacles caps also create a shock hazard due to their tendency to pull partially out of a receptacle, leaving exposed prongs that remain connected to electrical power. A child can easily touch these with their small fingers or a conductive object.

SUMMARY

In an aspect, there is provided a faceplate for an electrical receptacle having a safety measure, the electrical receptacle comprising one or more electrical sockets having a set of electrical terminals, the faceplate comprising: a cover mountable on the electrical receptacle, the cover having cover apertures corresponding to the electrical terminals of each of the electrical sockets; a pair of horizontally opposed pinching members on the cover; and a shield connected to the pair of horizontally opposed pinching members and mutually biased to block access to at least one of the electrical sockets, the shield configured to permit access to the at least one of the electrical sockets while the pair of horizontally opposed pinching members are engaged by a user.

In a particular case, the pair of horizontally opposed pinching members are engaged when each of the pinching members a slid in the proximal direction.

In another case, the pair of horizontally opposed pinching members are located on or near a periphery of the cover.

In yet another case, the shield comprises a left shield configured to block access to one of the electrical terminals of the electrical socket and a right shield configured to block access to a separate one of the electrical terminals of the electrical socket.

In yet another case, the left shield and the right shield each define a shield aperture dimensioned to receive an electrical prong there-through, and engaging the pair of horizontally opposed pinching members aligns the shield apertures with the respective cover apertures.

In yet another case, sliding the pair of horizontally opposed pinching members in the proximal direction slides the left shield and the right shield in the proximal direction until the shield apertures align with the respective cover apertures.

In yet another case, sliding the pair of horizontally opposed pinching members in the proximal direction slides the left shield and the right shield in the distal direction until the shield apertures do not block the respective cover apertures.

In yet another case, the left shield and the right shield are in an overlapping arrangement such that the left shield and the right shield both block access to both electrical terminals of the electrical socket, and access is permitted to any one of the electrical terminals only when both the horizontally opposed pinching members are concurrently engaged.

In yet another case, the pair of horizontally opposed pinching members are each located in a cavity defined in the cover, and the movement of the pinching members is constrained by the dimensions of such cavity.

In yet another case, the shield is biased by a torsion spring.

In yet another case, the shield is biased by a compression spring.

In yet another case, the biasing force on each of the right shield and the left shield is approximately equivalent to a compression-opposing rate of force in the range of 8 to 11 pounds-per-inch.

In yet another case, the biasing force on each of the right shield and the left shield is approximately equivalent to a compression-opposing rate of force of 9.7 pounds-per-inch.

In yet another case, the faceplate further comprising color indicators to indicate whether the shield is blocking access to at least one of the electrical sockets or the shield is permitting access to at least one of the electrical sockets.

In yet another case, the electrical receptacle comprises two or more electrical sockets, and the faceplate further comprises another pair of horizontally opposed pinching members and another shield for each of the additional electrical sockets.

In yet another case, the faceplate further comprising a rear enclosure to conceal at least a portion of the rear of the cover.

In another aspect, there is provided a method for providing a safety measure to an electrical receptacle, the electrical receptacle comprising one or more electrical sockets having a set of electrical terminals, the method comprising: biasing a shield to block access to at least one of the electrical sockets; biasing a pair of horizontally opposed pinching members in a lateral direction; and permitting access to said at least one of the electrical sockets while the pair of horizontally opposed pinching members are slid in the proximal direction for insertion by an electrical plug into the electrical receptacle.

In a particular case, biasing the shield comprises biasing a left shield to block access to one of the electrical terminals and biasing a right shield to block access to another one of the electrical terminals.

In another case, sliding one of the horizontally opposed pinching members in the proximal direction moves the left shield to permit access to the respective electrical terminal, and sliding the other one of the horizontally opposed pinching members in the proximal direction moves the right shield to permit access to the respective electrical terminal.

In yet another case, moving the left shield to permit access to the respective electrical terminal comprises moving the left shield such that an aperture in the left shield aligns with the respective electrical terminal, and moving the right shield to permit access to the respective electrical terminal comprises moving the right shield such that an aperture in the right shield aligns with the respective electrical terminal.

In yet another aspect, there is provided an electrical receptacle comprising the faceplate described above.

These and other aspects are contemplated and described herein. It will be appreciated that the foregoing summary sets out representative aspects of the embodiments to assist skilled readers in understanding the following detailed description. It is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

DESCRIPTION OF THE DRAWINGS

A greater understanding of the embodiments will be had with reference to the Figures, in which.

DETAILED DESCRIPTION

Figure 1:
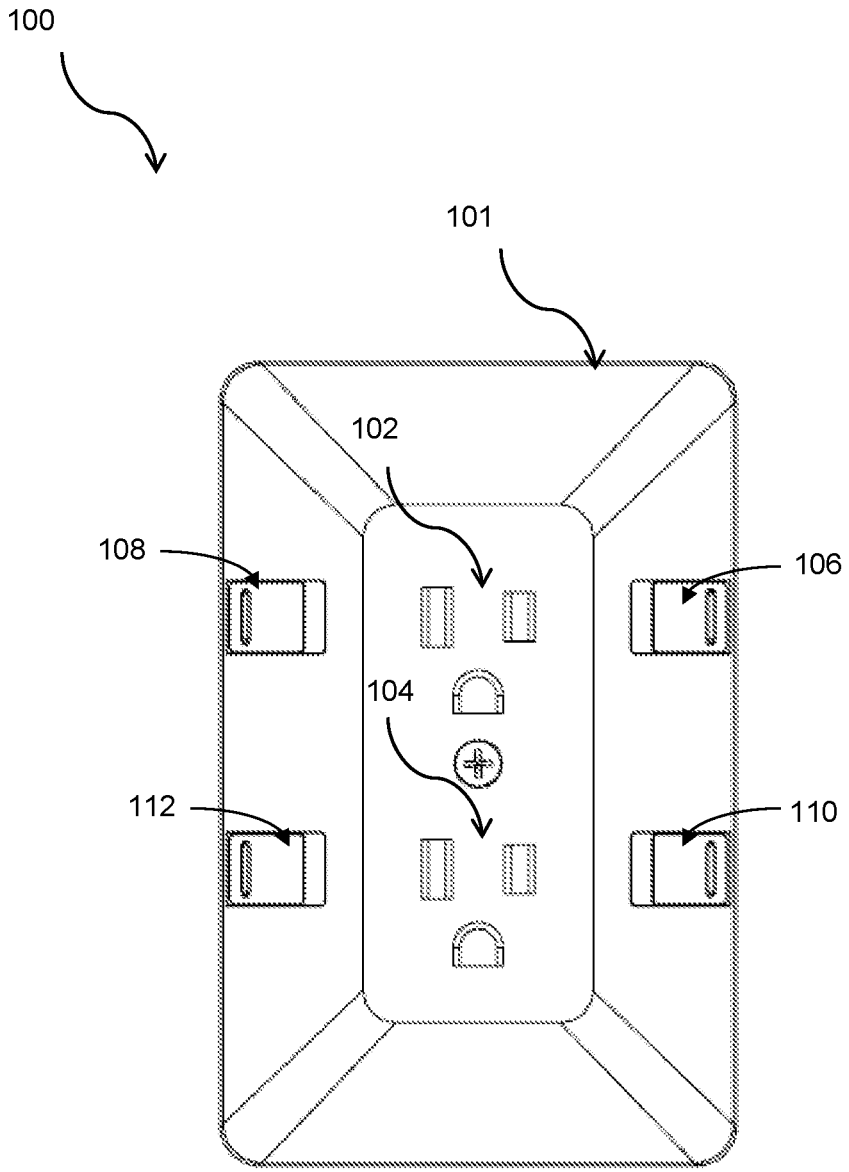
FIG. 1 illustrates a front view of a safety faceplate for an electrical receptacle, according to an embodiment.

For simplicity and clarity of illustration, where considered appropriate, reference numerals may be repeated among the Figures to indicate corresponding or analogous elements. In addition, numerous specific details are set forth in order to provide a thorough understanding of the embodiments described herein. However, it will be understood by those of ordinary skill in the art that the embodiments described herein may be practised without these specific details. In other instances, well-known methods, procedures and components have not been described in detail so as not to obscure the embodiments described herein. Also, the description is not to be considered as limiting the scope of the embodiments described herein.

Various terms used throughout the present description may be read and understood as follows, unless the context indicates otherwise: "or" as used throughout is inclusive, as though written "and/or"; singular articles and pronouns as used throughout include their plural forms, and vice versa; similarly, gendered pronouns include their counterpart pronouns so that pronouns should not be understood as limiting anything described herein to use, implementation, performance, etc. by a single gender; "exemplary" should be understood as "illustrative" or "exemplifying" and not necessarily as "preferred" over other embodiments. Further definitions for terms may be set out herein; these may apply to prior and subsequent instances of those terms, as will be understood from a reading of the present description.

The present disclosure relates generally to faceplates for electrical receptacles and more specifically to a faceplate having a safety measure.

The faceplate of the embodiments described herein is advantageously tamper resistant while being an easier solution than conventional receptacle covers. The faceplate of the embodiments described herein advantageously allows users to install the faceplate easily, eliminating the need to unwire the electronic components of a receptacle.

In particular embodiments, the faceplate described herein can be suitable for Decora™ style receptacles or common style duplex receptacles.

In some instances, sliding receptacle covers can be used to limit access to an electrical receptacle for safety reasons. Generally, to insert a plug, a user typically needs to slide such receptacle covers to an open position. However, such approaches generally require that a sliding plate be slid above or below an electrical receptacle when a plug is in use; which is widely considered not visually appealing. Further, such approaches may lack sufficient child tampering competences as children may learn the sliding open motion over time through observation, thus defeating an intended safety element of the receptacle cover.

In further instances, boxes with locking mechanisms that cover or replace the electric receptacle can be used to limit access to a receptacle for safety reasons. Generally, these approaches are large, expensive, difficult to use, and difficult to install. In other instances, approaches can use a swinging door that can be locked with switches or magnets. However, typically in these approaches the key or unlocking magnet can be easily lost or misplaced.

Turning to FIG. 1, there is shown a front view of a faceplate 100 for an electrical receptacle in accordance with an embodiment. The faceplate 100 includes a first socket 102 for receiving a first electrical plug (not shown) and a second socket 104 for receiving a second electrical plug (not shown). The faceplate 100 further includes a cover 101 to cover the areas of the electrical receptacle that do not provide access to the electrical sockets 102, 104. In this embodiment, the socket is a typical 15-ampere North American three-prong type socket (NEMA 5-15 grounded (Type B)). In other embodiments, the faceplate 100 can be configured to be used with other types of sockets; for example, a NEMA 1-15 ungrounded (Type A) socket, a NEMA 5-20 socket, a CEE 7/1 unearthed socket, or the like. A skilled reader will appreciate that the teachings of the present disclosure is applicable to various national and international standard socket configurations. In further embodiments, the faceplate 100 can be configured to be used with other electrical receptacle configurations; for example, with electrical receptacles having one socket, three sockets, or the like.

In this embodiment, the faceplate 100 includes a first set of horizontally-opposed left 108 and right 106 pinching members, and a second set of horizontally-opposed left 112 and right 110 pinching members.

Figure 3:
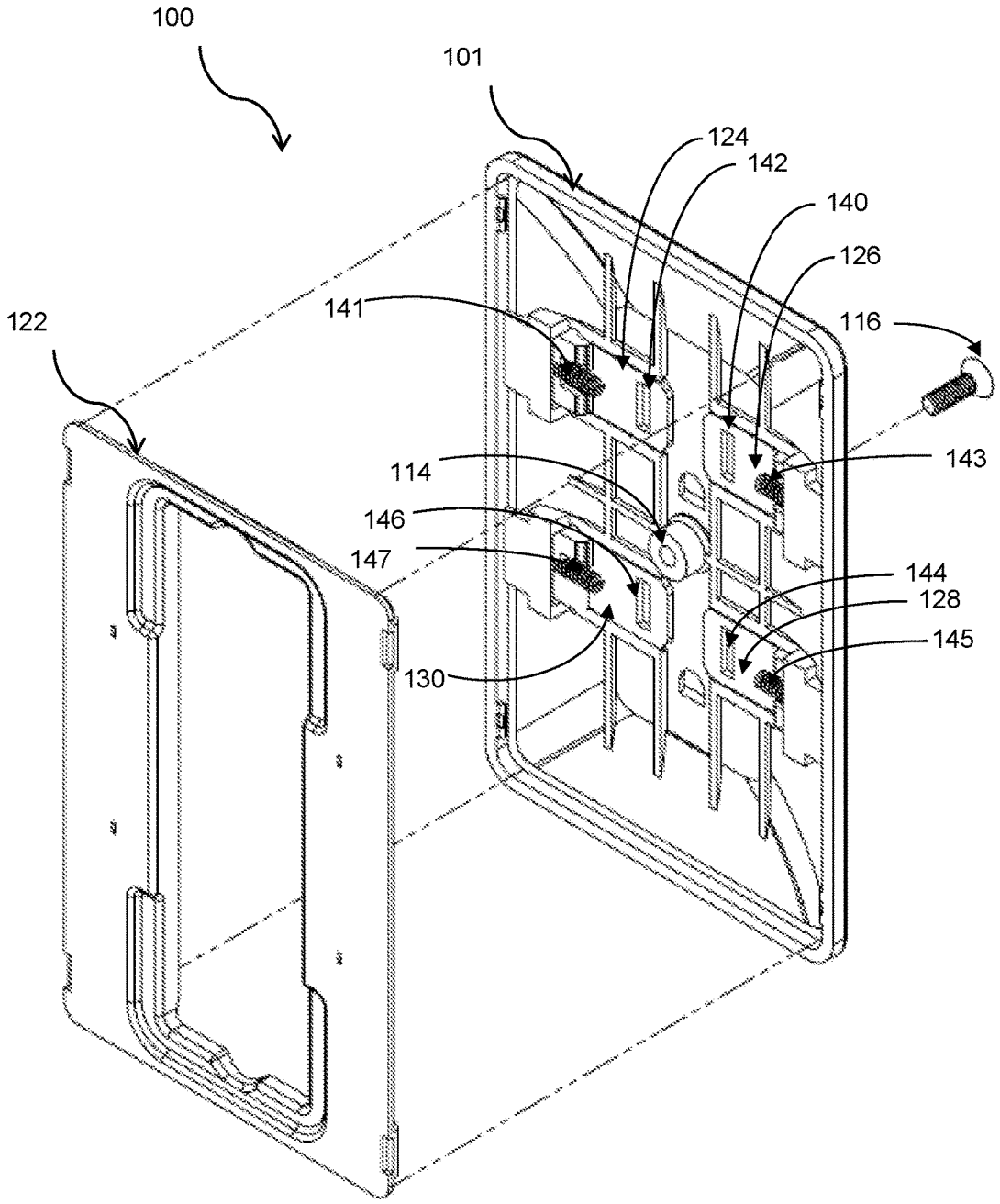
FIG. 3 illustrates a rear perspective partial-exploded view of the safety faceplate, according to the embodiment of FIG. 1.

As shown in FIG. 3, the faceplate 100 is dimensioned and configured to be mounted over a standard electrical receptacle (not shown). The receptacle includes an appropriate screw passage 114 to receive there-through a mounting screw 116 to be received by the electrical receptacle. In further cases, there may be other means of attaching the faceplate 100 to the electrical receptacle, including having multiple complementary screws and screw passages.

Figure 4:
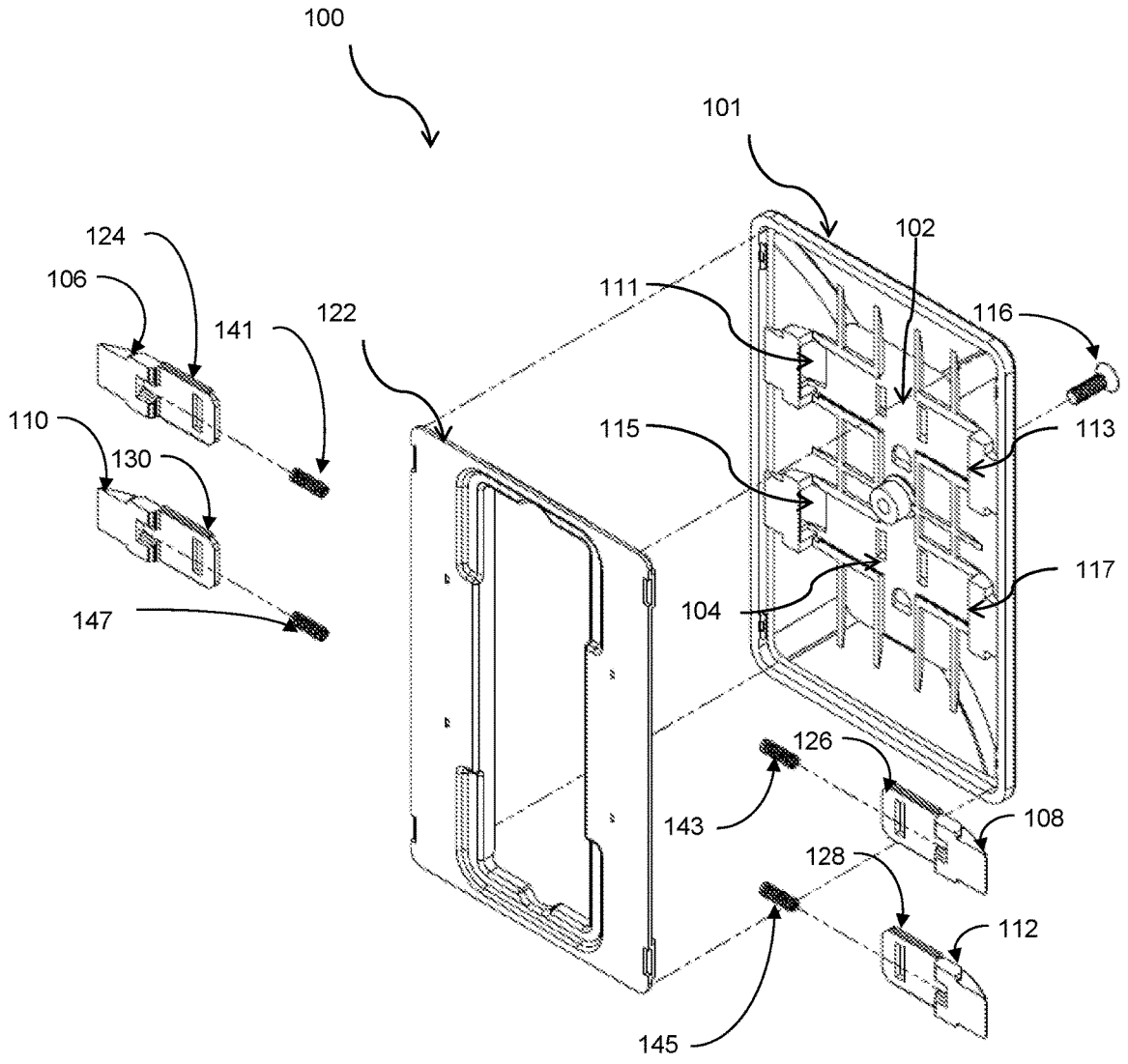
FIG. 4 illustrates a rear perspective exploded view of the safety faceplate, according to the embodiment of FIG. 1.
Figure 5:
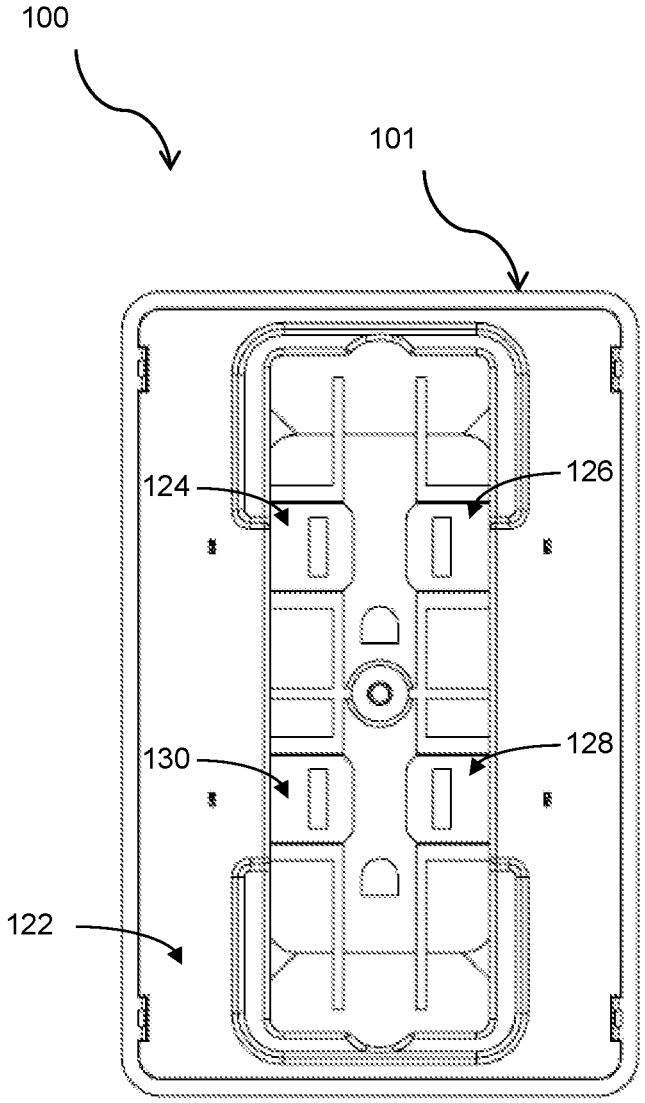
FIG. 5 illustrates a rear view of the safety faceplate, according to the embodiment of FIG. 1.
Figure 6:
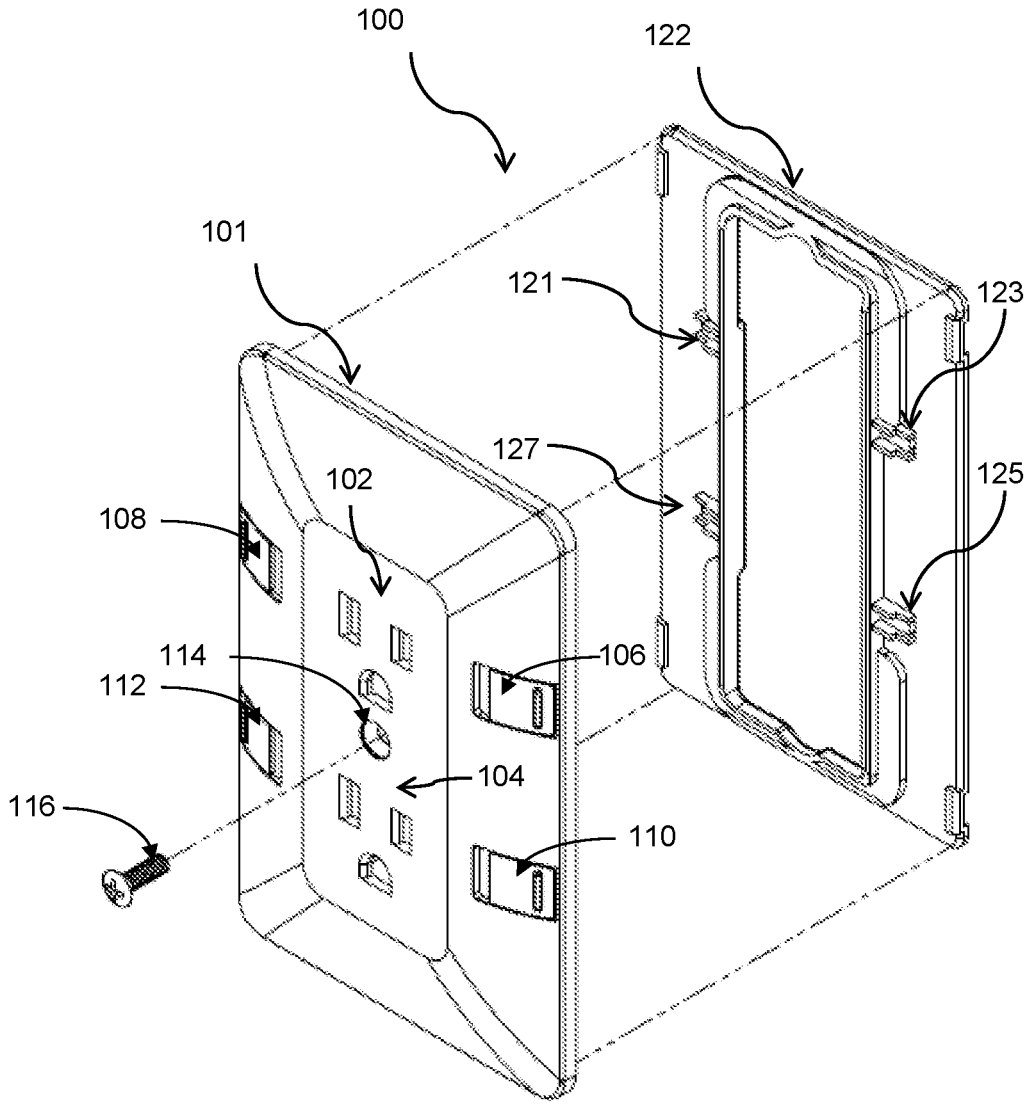
FIG. 6 illustrates a front perspective partial-exploded view of the safety faceplate, according to the embodiment of FIG. 1.
Figure 7:
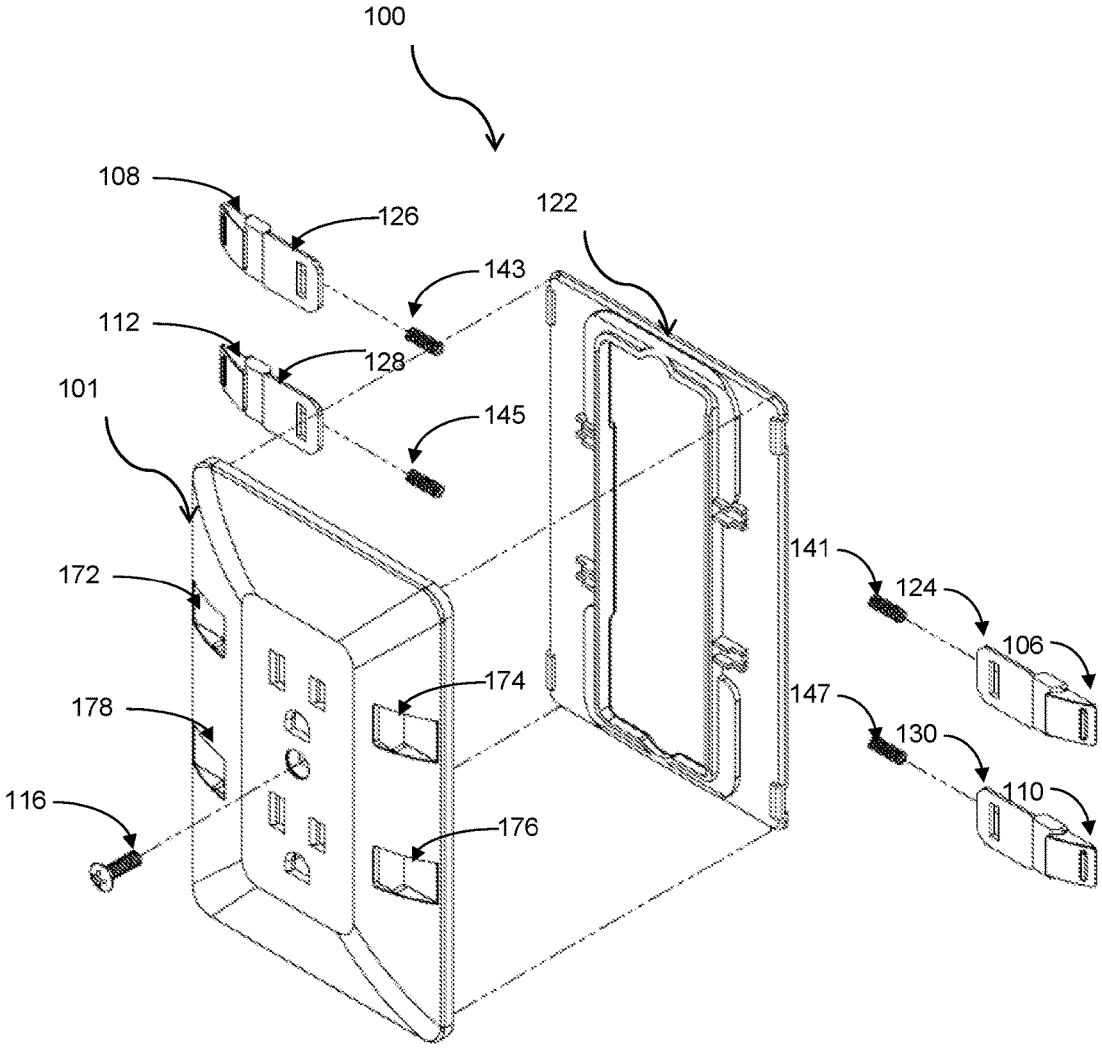
FIG. 7 illustrates a front perspective exploded view of the safety faceplate, according to the embodiment of FIG. 1.

For the purposes of illustrating the present embodiment, as described herein, FIG. 3 shows a rear perspective partial-exploded view of the faceplate 100, FIG. 4 shows a rear perspective exploded view of the faceplate 100, FIG. 6 shows a front perspective partial-exploded view of the faceplate 100, and FIG. 7 shows a front perspective exploded view of the faceplate 100. FIG. 5 shows a rear view of the faceplate 100.

In this case, the rear of the faceplate 100 includes a rear enclosure 122 to cover the internal mechanisms of the faceplate 100. In further cases, the rear of the faceplate 100 can be open and not include the rear enclosure 122.

As seen in FIGS. 3, 4, 5 and 6, for the first socket 102, there is a left shield 126 covering the neutral electrical terminal and right shield 124 covering the line electrical terminal; and for the second socket 104, there is a left shield 128 covering the neutral electrical terminal and right shield 130 covering the line electrical terminal.

As best shown in FIGS. 4 and 6, for the first socket 102, the left shield 126 is slidably connected to the left pinching member 108 and the right shield 124 is slidably connected to the right pinching member 106. Similarly, for the second socket 104, the left shield 128 is slidably connected to the left pinching member 112 and the right shield 130 is slidably connected to the right pinching member 110. A front side portion of each of the pinching members 106, 108, 110, 112 is externally available to the front side of the cover 101 in order to be engaged by the user. The pinching members 106, 108, 110, 112 connect to the respective shields 124, 126, 128, 130 through respective openings 111, 113, 115, 117 in the cover 101, such that the shields 124, 126, 128, 130 are located on the rear side of the cover 101. In further embodiments, the shields 124, 126, 128, 130 can be located on the front side of the cover 101.

The shields 124, 126, 128, 130 are actively biased by a biaser such that without user intervention, the shields 124, 126, 128, 130 cover their respective electrical terminal. Thus, such shields 124, 126, 128, 130 prevent unsafe access by children and the like. In the present embodiment, the biaser includes a spring to force the shields 124, 126, 128, 130 in the lateral direction. In this case, there is a compression spring 141, 143, 145, 147 in mechanical communication with each of the shields 124, 126, 128, 130, respectively, to bias the right shields 124 and 130 in the rightward direction and the left shields 126 and 128 in the leftward direction; such that the shields 124, 126, 128, 130 cover their respective terminals. In this case, the end of each of the compression springs 141, 143, 145, 147 opposing the shields 124, 126, 128, 130 is abutted against a respective abutment 121, 123, 125, 127; which are fixed with respect to, and located on, the rear enclosure 122. In further cases, the abutments 121, 123, 125, 127 can be fixed with respect to, and located on, the cover 101. In most cases, it is contemplated that the force provided by the biaser on the shields 124, 126, 128 can be selected to be in a range that is substantially difficult for an average child to overcome, but reasonably easily engageable by an adult or young adult. For example, in some cases, the compression springs 141, 143, 145, 147 can each have a compression-opposing rate of force in the range of approximately 8 to 11 pounds-per-inch; and in a particular case, the compression springs 141, 143, 145, 147 can each have a compression-opposing rate of force of approximately 9.7 pounds-per-inch. In some cases, the compression springs 141, 143, 145, 147 can each have a maximum load of, for example, approximately 2 pounds of force.

In a further embodiment, the shields 124, 126, 128, 130 can be biased using two torsion springs. For example, a first torsion spring in mechanical communication with the left shields 126, 128 to bias the left shields 126, 128 leftward and a second torsion spring in mechanical communication with the right shields 124, 130 to bias the right shields 124, 130 rightward. The torsion springs can be mounted around respective anchors, which are fixed with respect to the cover 101. In yet further embodiments, other biasing means may be used.

In this embodiment, cavities or cut-outs 172, 174, 176, 178 in the exterior of the faceplate 100 limit the movement of the respective pinching members 106, 108, 110, 112 in the proximal and distal directions, as generally shown in FIG. 7. In other embodiments, other stoppers may be used to limit the travel of the pinching members 106, 108, 110, 112.

As shown in FIG. 3, each of the shields 124, 126, 128, 130 includes a respective shield aperture 140, 142, 144, 146. The shield apertures 140, 142, 144, 146 are dimensioned to let pass there-through prongs of an electrical plug.

In operation, a user can exert a proximal force on both of the horizontally-opposed left 108 and right 106 pinching members to access the first socket 102, or exert a proximal force on both of the horizontally-opposed left 112 and right 110 pinching members to access the second socket 104. With respect to the first socket 102, when a sufficient force is exerted by the user, the shield aperture 140 on the left shield 126 aligns with the aperture for the respective terminal in both the cover 101 and the electrical receptacle. Similarly, the shield aperture 142 on the right shield 124 aligns with the aperture for the respective terminal in both the cover 101 and the electrical receptacle. When both shield apertures 140, 142 are aligned, the user can insert an electrical plug into that socket 102. As shown in FIGS. 6 and 7, an electrical plug is inserted into the second socket 104 when the pinching members 110, 112 have been sufficiently moved in the proximal direction. When such plug is inserted into the faceplate 100 and receptacle, the prongs travel through the respective shield apertures 144, 146, thereby preventing the pinching members 110, 112 and shields 128, 130 from moving back laterally as urged by the compression springs 141, 143. When the plug is removed from the receptacle and faceplate 100, the biasers will urge the shields outward to again cover the socket 104, preventing access to the socket 104 without further re-engaging the pinching members.

Figure 8:
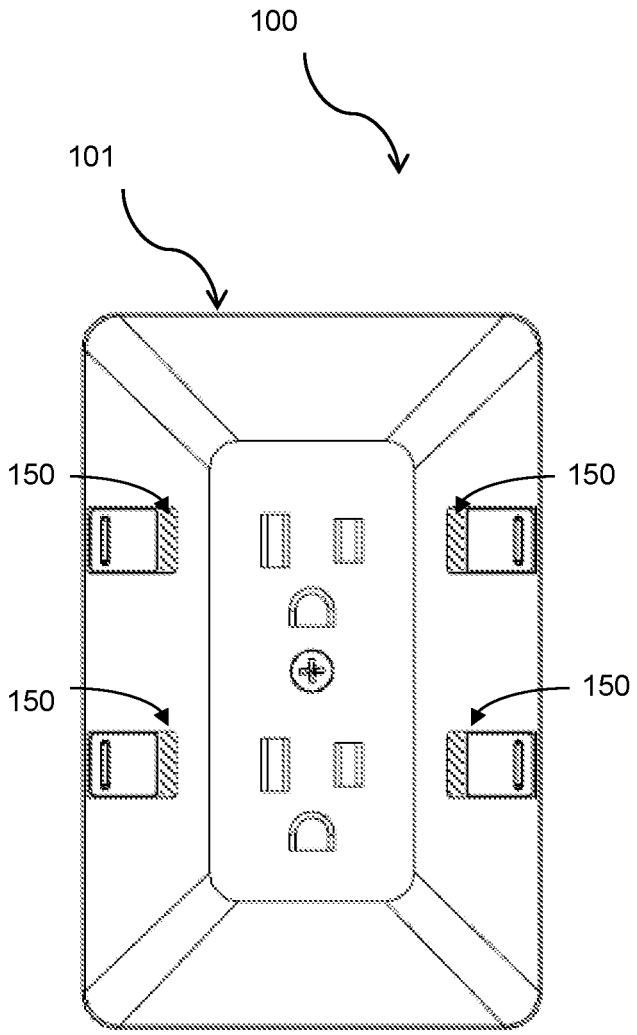
FIG. 8 illustrates a front view of the safety faceplate, according to the embodiment of FIG. 1.

In a particular embodiment, as shown in FIG. 8, the faceplate 100 can include indicators to indicate to the user when the shields 124, 126, 128, 130 are covering the terminals or when the shields 124, 126, 128, 130 are not covering the terminals. In this case, color indicators 150, are provided to indicate the state of the shields 124, 126, 128, 130 to the user. In this case, red color indicators 150 (shown as diagonal pattern fill) are externally exposed and visible when the when the shields 124, 126, 128, 130 are not covering the terminals, and green color indicators (not shown) are externally exposed and visible when the shields 124, 126, 128, 130 are covering the terminals.

Figure 9:
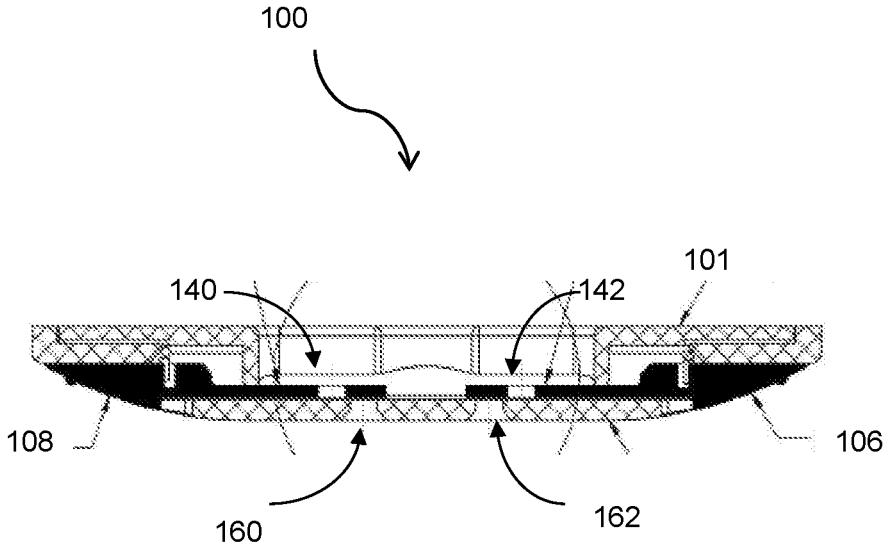
FIG. 9 illustrates a top view of the safety faceplate, according to the embodiment of FIG. 1.
Figure 10:
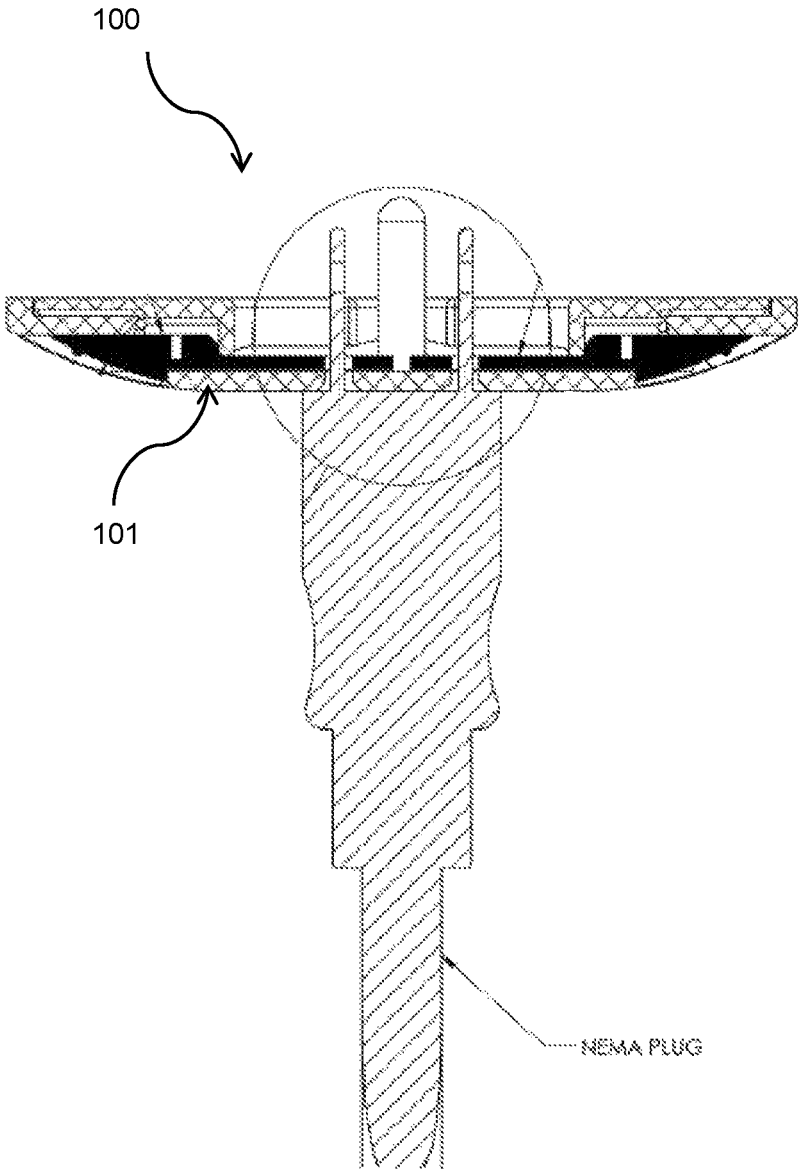
FIG. 10 illustrates a top view of the safety faceplate with an electrical plug inserted, according to the embodiment of FIG. 1.

FIGS. 9 and 10 show a top side schematic view of the faceplate 100 without an electrical plug inserted and with an electrical plug inserted, respectively. As shown in FIG. 9, in a shielded configuration, the shield apertures 140, 142 do not align with respective apertures 160, 162 in the cover 101 corresponding the line and neutral terminals. As shown in FIG. 10, in an unshielded configuration, when the pinching members 110, 112 have been sufficiently moved in the proximal direction, the shield apertures 140, 142 align with respective apertures 160, 162 in the cover 101 permitting ingress of the respective prongs of the electrical plug through the shield apertures 140, 142 and cover apertures 160, 162.

Figure 2:
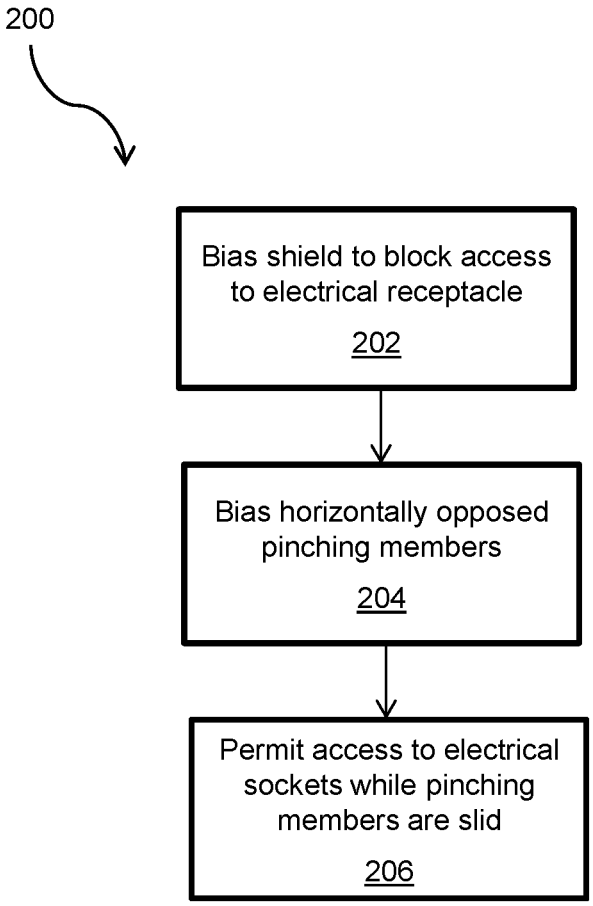
FIG. 2 illustrates a flowchart for preventing access to an electrical receptacle, according to an embodiment.

As shown in FIG. 2, in accordance with the embodiments described herein, a method 200 for providing a safety measure to an electrical receptacle is provided. At block 202, a shield is biased to block access to at least one electrical socket of the electrical receptacle. At block 204, a pair of horizontally opposed pinching members are each biased in a lateral direction. At block 206, access is permitted to said at least one of the electrical sockets while the pair of horizontally opposed pinching members are slid in the proximal direction for insertion by an electrical plug into the electrical receptacle.

In further embodiments, biasing the shield includes biasing a left shield to block access to one of the electrical terminals and biasing a right shield to block access to another one of the electrical terminals. In a particular case, sliding one of the horizontally opposed pinching members in the proximal direction moves the left shield to permit access to the respective electrical terminal, and sliding the other one of the horizontally opposed pinching members in the proximal direction moves the right shield to permit access to the respective electrical terminal. In another case, moving the left shield to permit access to the respective electrical terminal includes moving the left shield such that an aperture in the left shield aligns with the respective electrical terminal, and moving the right shield to permit access to the respective electrical terminal includes moving the right shield such that an aperture in the right shield aligns with the respective electrical terminal.

The faceplate 100 is preferably made of a non-conductive durable material, with the exception of the springs and screws being made of metal components.

In further embodiments, the edge of the faceplate 100 can include an insulating material to seal against the wall of the receptacle in order to prevent air from entering the room when the receptacle is located on an outer wall.

In further embodiments, pinching a single set of horizontally-opposed left 108 and right 106 pinching members can be configured to make both the first socket 102 and the second socket 104 be in the unshielded configuration.

While in the present embodiments the pinching members are generally on the same horizontal axis as the respective electrical terminals, it is appreciated that the pinching members can be located at various vertical locations on the faceplate 100. Additionally, while the pinching members are generally located at or near the periphery of the cover, it appreciated that the pinching members can be located closer together along the horizontal axis.

In further embodiments, there may be different types and configurations for shielding the electrical terminals. For example, the faceplate 100 can be configured such that proximal movement of the pinching members causes a single shield to progress away from the apertures in the cover 101, exposing the terminals. In further cases, the shields could be continuous and not include the shield apertures therein; and the faceplate 100 can be configured such that pinching of the pinching members causes the shields to move laterally. In this case, the shields can move far enough that the ends of the shields retract past the apertures in the cover, exposing the electrical terminals.

In further embodiments, the faceplate 100 can be configured such that moving the pinching members laterally causes the socket to go into the unshielded configuration.

Figure 11:
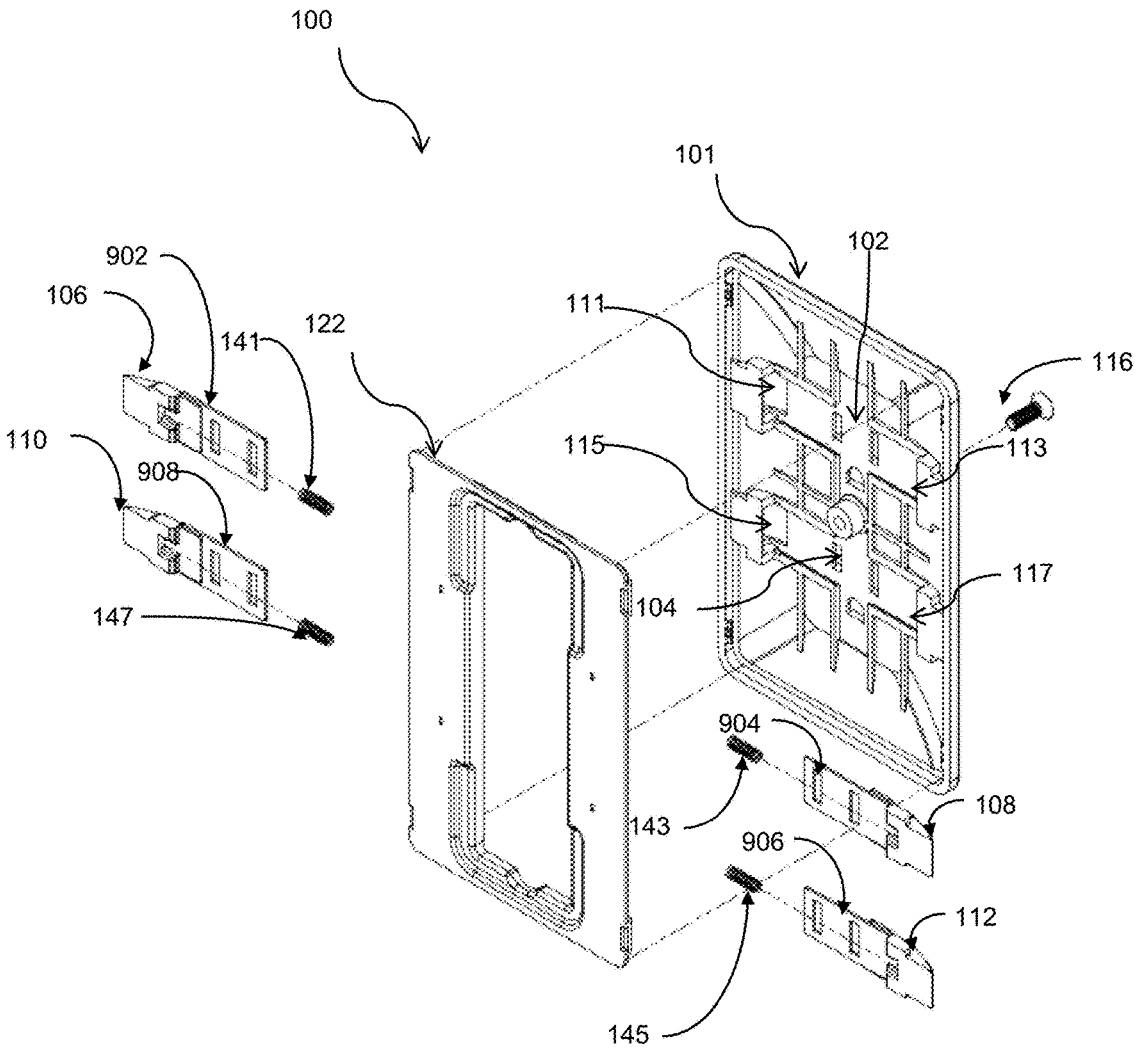
FIG. 11 illustrates a rear perspective exploded view of the safety faceplate, according to another embodiment.
Figure 12:
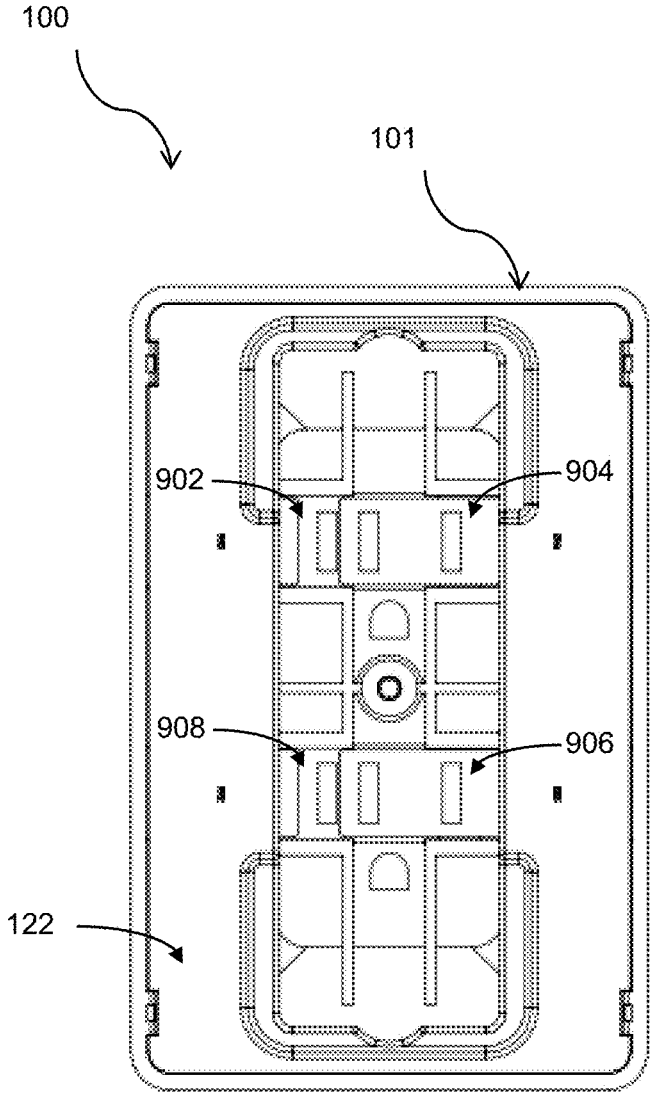
FIG. 12 illustrates a rear view of the safety faceplate, according to the embodiment of FIG. 11.

In further embodiments, as illustrated in FIGS. 11 and 12, with respect to, for example, the first socket 102, a left shield 902 (or 908) can extend to cover both terminals. Similarly, a right shield 904 (or 906) can extend to cover both terminals. In the case, the left shield 902 (or 908) and right shield 904(or 906) can be arranged in an overlapping manner. When the left pinching member 108 is engaged, the left shield 902 (or 908) is slid such that it no longer blocks access to any of the terminals; this can be configured by having two shield apertures that align with the two cover apertures, or by having one shield aperture that aligns with the left cover aperture and having the distal end of the left shield 902 (or 908) dimensioned to no longer block the right cover aperture. Similarly, when the right pinching member 106 is engaged, the right shield 904 (or 906) is slid such that it no longer blocks access to any of the terminals; this can be configured by having two shield apertures that align with the two cover apertures, or by having one shield aperture that aligns with the right cover aperture and having the distal end of the right shield 904 (or 906) dimensioned to no longer block the left cover aperture. Advantageously, the arrangement of this embodiment means that if a child were to engage one of the pinching members 106, 108, then such child would still have no access to either one of the electrical terminals.

In further embodiments, the faceplate 100 may also include a shield to cover a ground pin of the electrical socket 102, 104. The shield for the ground pin can be slid to an unshielded configuration by one of the existing pinching members pinching members 106, 108, 110, 112 or by its own separate pinching member. In further cases, one or more of the other shields 124, 126, 128, 130 may be configured to also cover the grounding pin.

Applicant recognized several intended advantages of the embodiments described herein, for example, having more than a single release button or mechanism that can be easily overcome by a child. In contrast, the present embodiments have pinching members strategically located on or near the sides of the faceplate. This is advantageous because, as the Applicant has investigated, children's hands are generally too small and lack the required dexterity to pinch the pinching members in order to expose the electrical terminals. In the embodiments described herein, the biaser is configured to require significant strength from the user to slide pinching members into the unshielded configuration. Accordingly, most children will generally find it difficult, and possibly impossible, to access the electrical terminals under their own power.

Advantageously, the present embodiments permit the faceplate 100 to be easily retrofitted to existing electrical receptacles. In further embodiments, the faceplate 100 can be part of a kit, or generally included with an electrical receptacle.

As a further intended advantage, the embodiments described herein include automatic shielding of the electrical terminals when a plug is removed or not engaged. As such, the electrical receptacle is automatically protected from children and, unlike conventional approaches, does not rely on the user to remember to shield the electrical receptacle with, for example, a separate cover.

As a further intended advantage, the embodiments described herein include protection against insertion of an electrical plug half-way inside the socket by a child. In these situations, the prongs of the electrical plug can get electrified even when the plug is not fully inserted. The exposed portion of the prongs, between the cover and the handle of the plug, may be large enough for a child's finger to touch, and thus be exposed to dangerous live current. Thus, the shields of the embodiments described herein provide protection against such dangerous circumstances.

As a further intended advantage of the embodiments described herein, the push portions can be used with one hand, freeing the other hand to insert the electrical plug into the electrical receptacle.

As a further intended advantage, the embodiments described herein do not add substantial distance between the base of the electrical plug and the electrical receptacle. In a particular case, such distance is less than or equal to 3.8 mm. This is advantageous because having a large distance can cause poor engagement between the electrical prongs and the terminals of the electrical receptacle.

As a further intended advantage, the embodiments described herein are aesthetically pleasing due to not having to substantially alter the outward appearance of a standard faceplate; other than having the non-overly conspicuous, and aesthetically pleasing, push portions, which further might include colored safety indicators.

Although the invention has been described with reference to certain specific embodiments, various modifications thereof will be apparent to those skilled in the art without departing from the spirit and scope of the invention as outlined in the claims appended hereto.

The invention claimed is:

1. A faceplate for an electrical receptacle having a safety measure, the electrical receptacle comprising one or more electrical sockets having a set of electrical terminals, the faceplate comprising:

a cover mountable on the electrical receptacle, the cover having cover apertures corresponding to the electrical terminals of each of the electrical sockets;

a pair of horizontally opposed pinching members on the cover; and a right shield and a left shield each connected to one of the horizontally opposed pinching members and mutually biased to block access to at least one of the electrical sockets, the left shield and the right shield in an overlapping arrangement such that the left shield and the right shield both block access to both electrical terminals of the electrical socket, the left shield and the right shield configured to permit access to any one of the electrical terminals only when both of the horizontally opposed pinching members are concurrently engaged by a user.

2. The faceplate of claim 1, wherein the pair of horizontally opposed pinching members are engaged when each of the pinching members are slid in the proximal direction.

3. The faceplate of claim 1, wherein the pair of horizontally opposed pinching members are located on or near a periphery of the cover.

4. The faceplate of claim 1, wherein the left shield and the right shield each define a shield aperture dimensioned to receive an electrical prong there-through, and wherein engaging the pair of horizontally opposed pinching members aligns the shield apertures with the respective cover apertures.

5. The faceplate of claim 4, wherein sliding the pair of horizontally opposed pinching members in the proximal direction slides the left shield and the right shield in the proximal direction until the shield apertures align with the respective cover apertures.

6. The faceplate of claim 1, wherein the pair of horizontally opposed pinching members are each located in a cavity defined in the cover, and wherein the movement of the pinching members is constrained by the dimensions of such cavity.

7. The faceplate of claim 1, wherein the biasing force on each of the right shield and the left shield is approximately equivalent to a compression-opposing rate of spring force in the range of 8 to 11 pounds per inch of travel.

8. The faceplate of claim 7, wherein the biasing force on each of the right shield and the left shield is approximately equivalent to a compression-opposing rate of spring force of 9.7 pounds per inch of travel.

9. The faceplate of claim 1, wherein the shield is biased by a compression spring.

10. The faceplate of claim 1, further comprising color indicators to indicate whether the shield is blocking access to at least one of the electrical sockets or the shield is permitting access to at least one of the electrical sockets.

11. The faceplate of claim 1, wherein the electrical receptacle comprises two or more electrical sockets, and wherein the faceplate further comprises another pair of horizontally opposed pinching members and another shield for each of the additional electrical sockets.

12. An electrical receptacle comprising the faceplate of claim 1.

13. The faceplate of claim 1, wherein the left shield and the right shield each define at least two shield apertures, and wherein sliding both horizontally opposed pinching members in the proximal direction aligns the shield apertures of the left shield and the right shield with the respective cover apertures and respective electrical terminals.

14. A method for providing a safety measure to an electrical receptacle, the electrical receptacle comprising one or more electrical sockets having a set of electrical terminals, the method comprising:

biasing a right shield and a left shield to both block access to both electrical terminals of at least one of the electrical sockets, the left shield and the right shield in an overlapping arrangement;

biasing a pair of horizontally opposed pinching members in a lateral direction, each of the horizontally opposed pinching members connected to either the right shield or the left shield; and permitting access to any one of the electrical terminals of at least one of the electrical sockets only when both of the horizontally opposed pinching members are both engaged by a user by sliding both the horizontally opposed pinching members in the proximal direction for insertion by an electrical plug into the electrical receptacle.

15. The method of claim 14, wherein moving the left shield to permit access to the set of electrical terminals comprises moving the left shield such that a pair apertures in the left shield each align with a respective electrical terminal in the set of electrical terminals, and wherein moving the right shield to permit access to the set of electrical terminal comprises moving the right shield such that a pair of apertures in the right shield each align with a respective electrical terminal in the set of electrical terminals.

* * * * *